United States Patent [19]

Faith

[11] Patent Number: 4,976,440

[45] Date of Patent: Dec. 11, 1990

[54] ARCADE-TYPE PRIZE DISPENSING MACHINE

[76] Inventor: William B. Faith, 6530 Lakeridge Ave., Los Angeles, Calif. 90068

[21] Appl. No.: 313,409

[22] Filed: Feb. 21, 1989

[51] Int. Cl.[5] ..... A63B 67/00

[52] U.S. Cl. ..... 273/362; 221/2; 221/312 R; 273/363

[58] Field of Search ..... 273/362, 363, 364, 365; 221/2, 312 R

[56] References Cited

FOREIGN PATENT DOCUMENTS 637161 10/1936 Fed. Rep. of Germany ..... 273/362

*Primary Examiner*—William H. Grieb

*Attorney, Agent, or Firm*—Lyon & Lyon

[57] ABSTRACT

A game or prize dispensing apparatus and method which transfers prizes or objects from a lower position in the machine to an upper position of the machine, releasing the prizes and allowing them to freefall. The player attempts to strike or grab the falling prize by actuating a mechanism at the appropriate time. A successfully struck or grabbed prize may then be dispensed.

22 Claims, 9 Drawing Sheets

ARCADE-TYPE PRIZE DISPENSING MACHINE

BACKGROUND OF THE INVENTION

There are many machines of skill and chance to provide both challenge and entertainment for the player. Video arcades are full of mechanical devices such as pinball machines, basketball free throw shooting machines, and punching machines as well as a myriad electronic game machines such as video games.

One popular type of machine consists of a game of skill in which the player attempts to win a particular prize. A common prize dispensing machine found in arcades is the crane and claw device. This machine has a supply of potential prizes over which the player maneuvers a claw, releasing the claw in an attempt to grasp the prize. If the claw successfully grasps a prize, the claw retracts with the prize and deposits the prize in a prize dispensing slot.

Arcade game players enjoy games in which their skills are determinative of their success and in which they have control over the operation of the game. A game in which the operations of the mechanisms are clearly predictable and readily discernable is attractive to the arcade game player providing a challenge to the player's skills such as hand-to-eye coordination and manual dexterity.

Therefore it is desirable to have prize dispensing machine which provides the player clear control over the game.

SUMMARY OF THE INVENTION

The field of the present invention is directed to a machine and method for dispensing a prize or playing a game. Typically found in an arcade-type environment, the machine has a supply of objects or prizes such as small stuffed animals which are circulated and dropped from a dropping point in full view of the player. The player has a controller for actuating the mechanism for striking or grabbing the prize as it falls through the air. A prize that is successfully struck or grabbed is then dispensed to the player. By releasing the prizes and allowing them to freefall through the air, the machine clearly relinquishes control over the prizes. By watching the circulation of the prizes being moved from the lower portion of the machine up to the dropping portion of the machine, the player can see the randomness of the operation and feel in control of the game.

BRIEF DESCRIPTION OF THE DRAWINGS

FIG. 7 is a side elevation view of a machine embodiment having alternative striking means and conveying means:

DETAILED DESCRIPTION OF THE PREFERRED EMBODIMENTS

The present invention will now be described with respect to the drawings. For convenience of description, any numeral representing an element in one figure will represent the same element in any other figure.

Figure 1:
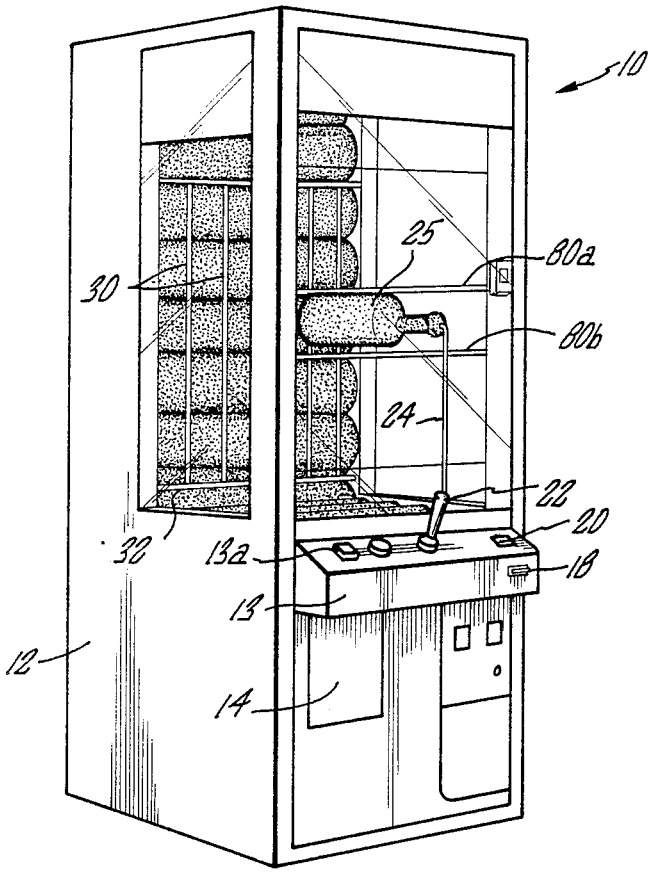
FIG. 1 is a perspective view of a prize dispensing machine according to preferred embodiment of the present invention.
Figure 2:
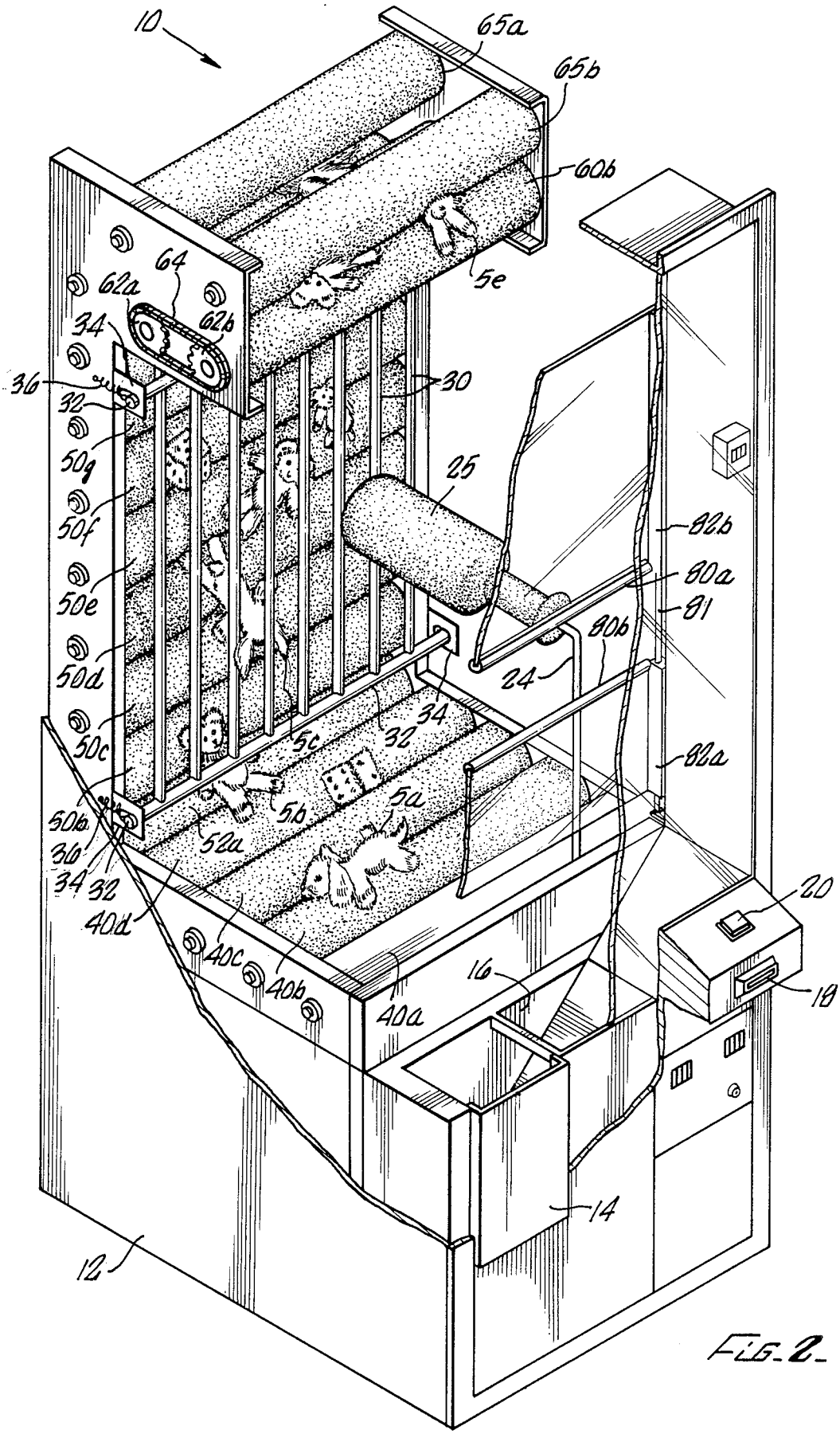
FIG. 2 is a diagrammatic perspective view of the machine of FIG. 1 with portions of the machine cutaway to better illustrate functional features.
Figure 3:
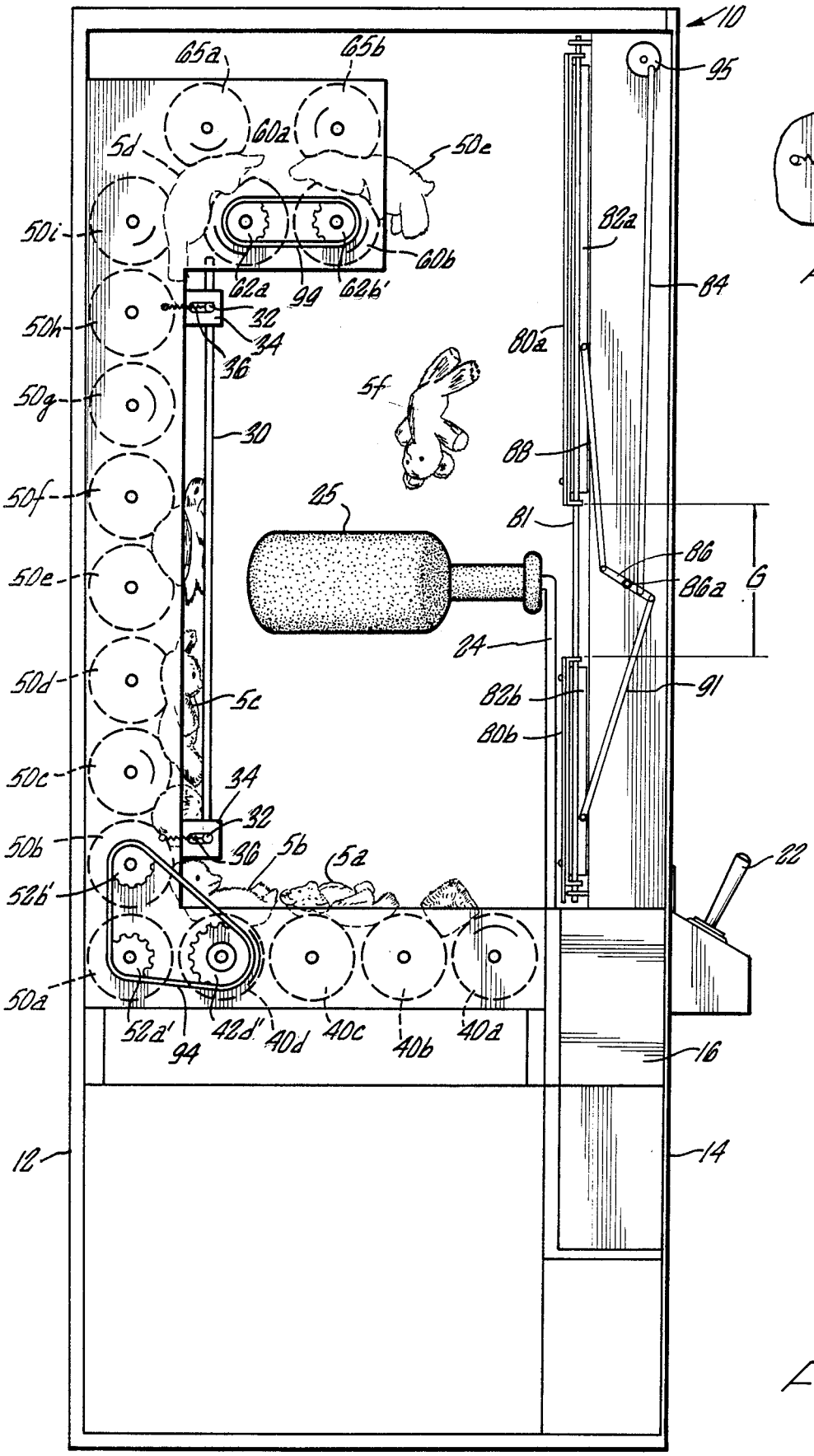
FIG. 3 is a left-side plan view of the machine of FIG. 2 diagrammatically illustrating internal mechanisms and machine operation.

FIGS. 1–3 illustrate the general mechanism of the prize dispensing machine 10 according to a preferred embodiment. Prize dispensing machine 10 includes an outer cabinet 12 having a control panel 13 on the front thereof. The control panel 13 includes the control buttons 13*a* and 20 as well as the bat actuation handle 22.

Within the dispensing machine 10 prizes 5 are circulated from a first position and a lower portion of the machine along the rollers 40*a–d* upward along the vertically oriented rollers 50*a–i* and then drop downward from between rollers 65*a–b* and 60*a–b* so as to freefall back downward to the first position at rollers 40*a–d*. The object of the game is for the player to actuate the bat actuating handle 22 when he feels a particular prize can be struck by the bat 25 through the gates 80*a–b*. If successful, a prize 5 falls into the dispensing area comprised of the dispenser chute 16 and can be claimed through dispenser door 14.

The specific function of the game will now be described with respect to FIGS. 2–3. A series of rollers 40*a–d* which could be termed as a collecting area of the machine 10, rotate in the same direction (counterclockwise as viewed in FIG. 3) transferring a prize (such as 5*a*) consecutively from roller 40*a* to roller 40*b* and so on until the prize 5*b* reaches and is contacted by rollers 50*a* and 50*b* whereupon the prize is pressed against a second surface which is shown to be a plurality of vertically oriented parallel bars having spaces therebetween, the spaces being small enough such that prizes are generally prevented from passing therethrough. The rollers 50*a–i* are horizontally oriented and stacked in a vertical plane, and being positioned parallel to one another, each roller is capable of pinching a prize between its outer surface and the bars 30 and as the rollers 50*a–i* rotate (counterclockwise as viewed in FIG. 3) they move the prize 5*b* progressively upward (such as prize 5*c*) until the prize reaches the top portion of the machine 10 adjacent to roller 50*i*. The prize 5*d* is then transferred between rollers 60*a* and 65*a* and then between rollers 60*b* and 65*b* until releasing the prize 5*e* allowing it to freefall, such as prize 5*f*, in front of the bat 25.

Figure 3A:
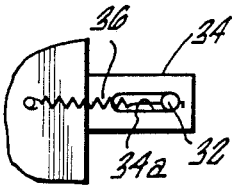
FIG. 3A is a detailed viewed of the bar support bracket in FIG. 3.

The vertical bars 30 are connected to horizontal bars 32 which are in turn adjustably held in place by brackets 34 as best viewed in the detail of FIG. 3A. The horizontal bar 32 slides within slot 34*a* in bracket 34 and is biased to the left as in FIG. 3A which exerts a pinching force toward the rollers 50*a–i* thereby pinching the prizes 5.

All the rollers preferably have a soft foam surface which gently but effectively handles the prizes. The surface also conforms to the shape of the object.

The bars 30 are preferably constructed from a clear material so as not to block the view of the circulating prizes. The bars 30 act as a second surface against which the prize may be pinched with the rollers 50*a–i*. The bars 30 are only one suitable second surface. For example, prizes could be pressed against a sheet of smooth glass in place of the bars 30. Alternately a set of corresponding rollers could be added as described below with respect to FIG. 7.

In order to successfully strike a falling prize with the bat 25, the prize must pass through the space or gap G between the gates 80*a* and 80*b*. The size of the space or gap G may be preset or selected by the player. In a coin operated game, the player may be required to expend additional money to increase the size of the gap G, thereby lowering the degree of difficulty required in successfully striking a prize through the gap G. A larger gap G may also be required depending upon the size of the prize.

The gates 80*a* and 80*b* are arranged so as to slide along a vertical pole 81 located on each side of the machine 10. The gates are typically constructed of a clear material through which the player may observe the circulating prizes. By depressing the gate control button 20 or possibly by inserting additional coins, the player may adjust the size of the gap G sliding the gates 80*a* and 80*b* away from each other. Movement of the gates 80*a* and 80*b* is provided by a linkage mechanism comprised of linkages 84, 88, 91 and pivot bracket 86. The wheel linkage 84 is pivotally connected to the motor wheel 95 and to the pivot bracket 86. The linkage 88 is pivotally connected on one end to the pivot bracket 86 and on its opposite end to a support brace 82 which in turn supports the gate 80*a* and the linkage 88. The linkage 91 is similarly pivotally connected on one end to the pivot bracket 86 and on its opposite end to the support bracket 82*b* which supports the gate 80*b*. The pivot bracket 86 is connected to the side of cabinet 12 and is allowed to pivot about its pivot point 86*a*. Upon actuation of the gate control button 20, a control signal is sent to a motor (not shown) which rotates the wheel 95 a given amount thereby translating the linkage 84 causing the pivot bracket 86 to pivot. Upon the pivoting of the pivot bracket 86, the linkages 80 and 91 move the gates 80*a* and 80*b* thereby adjusting the size of the gap G.

Figure 4:
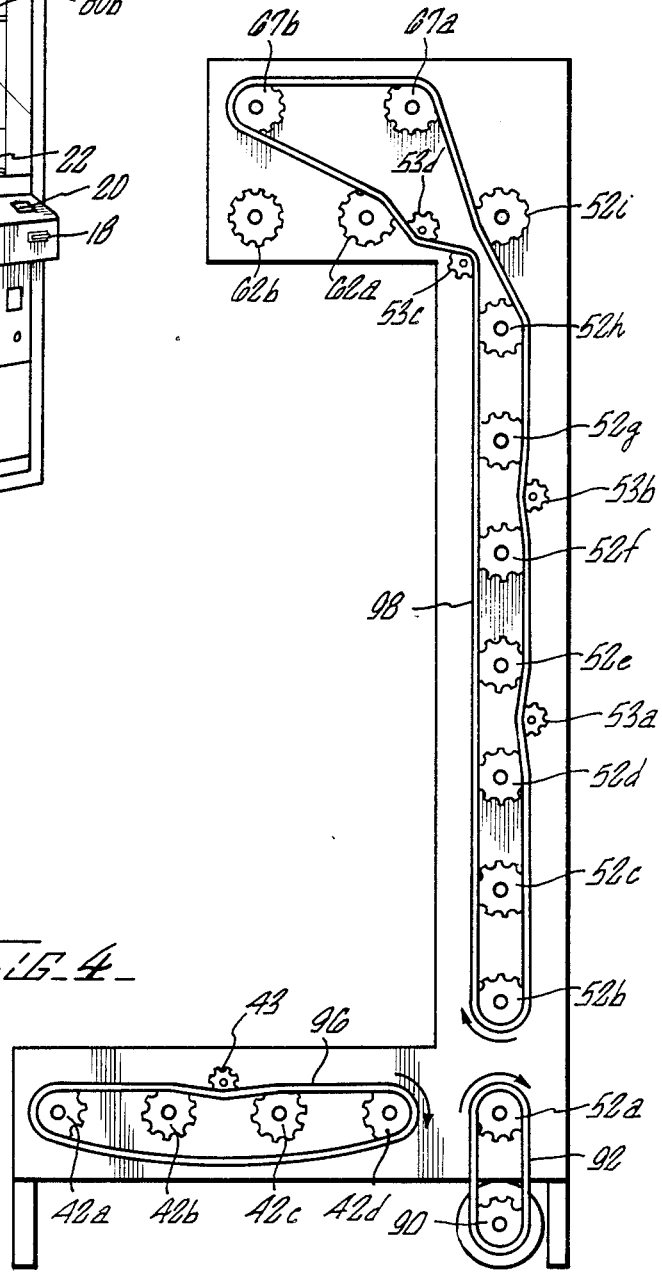
FIG. 4 is a right-side elevation view of the dispensing machine of FIG. 2 showing details of the rollers and drive mechanisms.
Figure 5:
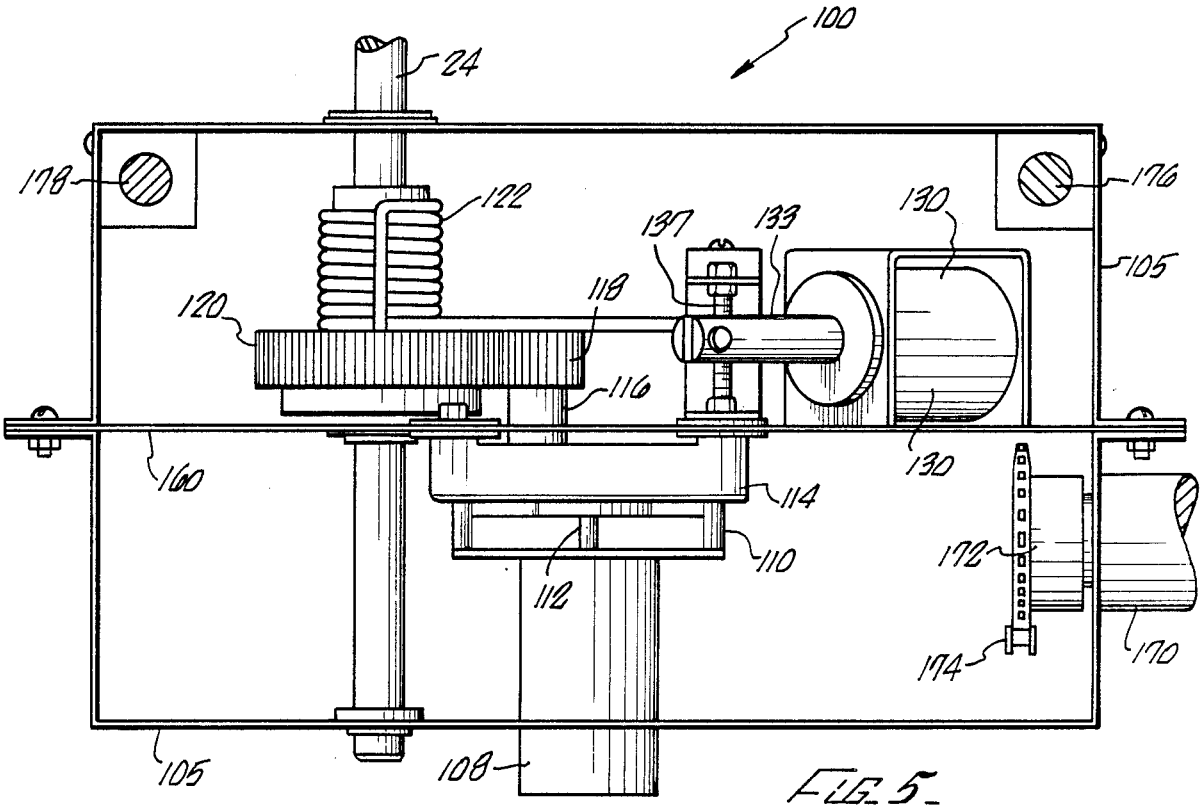
FIG. 5 is a detailed view of the bat mechanism of FIG. 2 showing details of the actuation means.

The prize circulating or transferring mechanisms will now be described with respect to FIGS. 3 and 5. A motor (not shown) behind motor drive wheel 90 rotates the drive wheel 90 in a clockwise direction as viewed in FIG. 4. The wheel gear 90 drives a chain 92 which rotates gear 52*a* which is in turn connected to roller 50*a*. As viewed in FIG. 3, rotation of roller 50*a* causes rotation of the gear 52*a'* on the opposite side of the roller 50*a* thereby actuating the rotation of chain 94 which in turn drives gear 42*d'* of roller 40*d* and gear 52*b'* of roller 50*b*. Rotation of roller 40*d* rotates gear 42*d* which in turn activates movement of the chain 96 driving gears 42*a*, 42*b* and 42*c* thereby rotating rollers 40*a–c*. The rotation of roller 50*b* is transferred to gear 52*b* where it is subsequently transferred along chain 98 to gears 52*c–i*, 62*a*, 67*a* and 67*b* providing rotation movement of their respective rollers. The last roller 62*b* is rotated by connection of its gear 62*b'* to the gear 62*a'* through chain 99. Tensioning gears 53*a*, 53*b*, 53*c*, and 53*d* provide for proper tensioning and positioning of the chain 98. The tensioning gear 43 may also be provided to adjust the tensioning of chain 96.

As already described, as the player actuates the bat actuating handle 22, the bat 25 is designed to be rotated by rotation of the rod 24 swinging to strike a particular prize, such as the freefalling prize 5*f* in FIG. 3, through the gap G between the gates 80*a* and 80*b*.

The bat actuating mechanism will now be described with respect to FIG. 5 and FIG. 6. The rod 24 is rotatably supported on the actuator frame 105. A drive gear 120 is attached to the rod 24 and rotates therewith. An engaging motor 108 mounted upon motor mount 110 drives a reduction/overrun gear 114 through the motor drive shaft 112. The reduction/overrun gear 114 outputs rotation at shaft 116 upon which a spur gear 118 engages the gear 120 on the rod 24. When the motor 108 is activated, the spur gear 118 engages and rotates the gear 120, rotating the rod 24, turning the actuation spring 122, thereby storing a force within the spring 122 and putting the bat 25 in position for a swing. When the bat 25 has reached a desired position and the spring 122 has achieved a desired force, the reduction/overrun gear 114 slips to stop transmission of rotation to the shaft 116 and the motor 108 shuts off.

In order to release the gear 120, several components including the motor 108, the motor mount 110, the reduction/overrun gear 114, the shaft 116 and the spur gear 118 are mounted together in a pivoting fashion on the plate 160. As best viewed in FIG. 6, the gear 114 is attached to the plate 160 by screw connection 140. The remaining three screw connections 142, 144, and 137 are allowed to slide along respective slots within the plate 160. Upon actuation of the solenoid 130, actuation shaft 133 translates the connector screw 137 along slot 162. The washer 137*a* permits a freedom of movement of the screw connection 137 along the slot 162. Similarly, connection screw 142 slides along slot 164 with a washer 142*a* providing the sliding freedom. Finally, connection screw 144 slides along slot 166 with washer 144*a* providing the freedom of movement. Connection screw 144 also provides a stopping point for the extension of the actuation spring 122.

Figure 6:
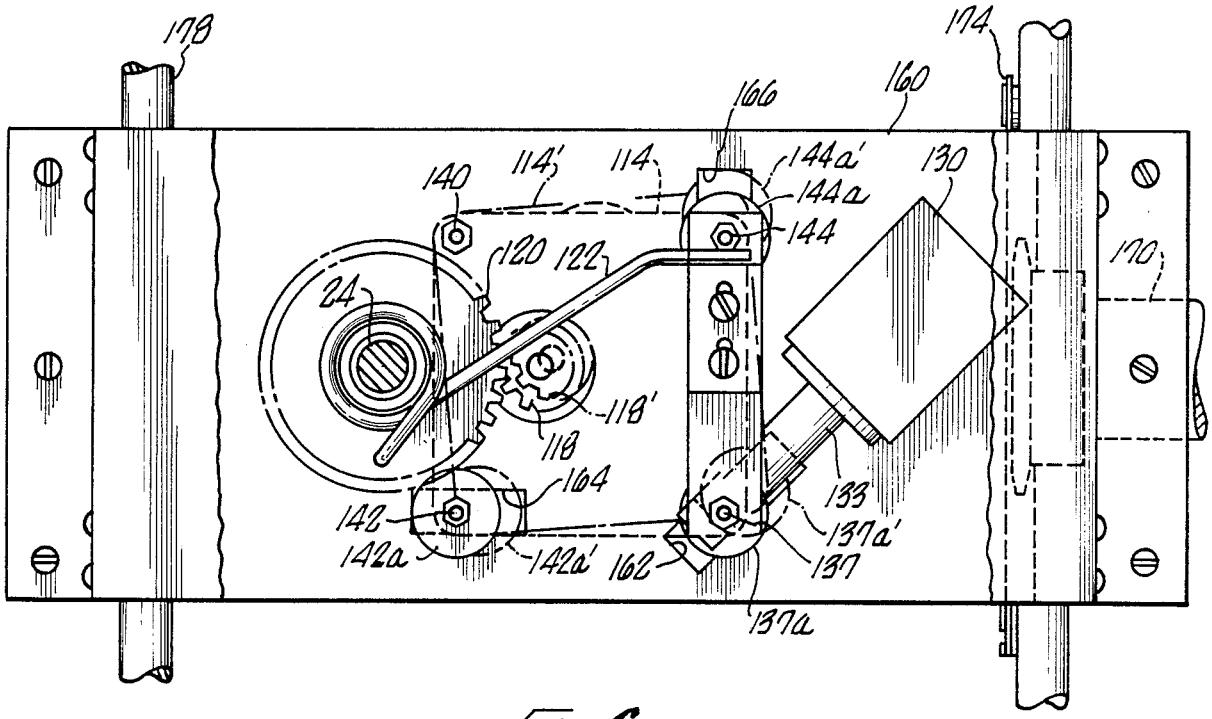
FIG. 6 is a top plan view of FIG. 5.
Figure 1:
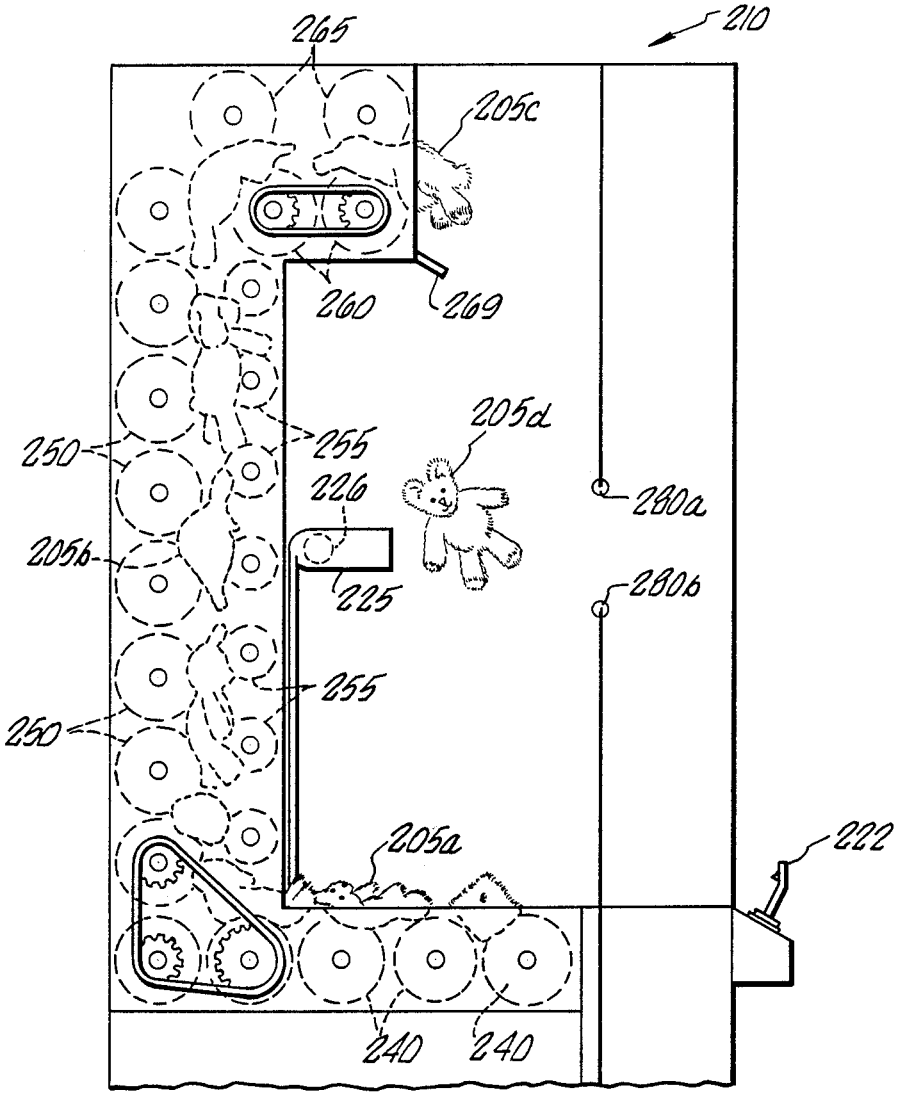

FIG. 6 shows the pivoting movement of the elements by indicating a first position of the elements with the spur gear 118 engaging the gear 120 in solid line and a second position of the element in phantom with the spur gear 118' disengaged from the drive gear 120. The second position is also shown by the other elements in phantom, specifically the reduction/overrun gear 114' and the washers 142*a'*, 137*a'* and 144*a'*. In order to actuate the bat 25, the gear 118 must be disengaged from the gear 120 by the pivoting action as described above. The solenoid 130 provides the motive force for this pivoting action through movement of its actuation shaft 133 attached to the connection screw 130. Therefore when the player signals he wishes to swing by moving the bat actuation handle 22 (as viewed in FIG. 3), a signal is sent to the solenoid 130 which retracts the actuation shaft 133, pulling the connection screw 137, and pivoting the components including the spur gear 118 out of engagement and thereby releasing the drive gear 120. Once the drive gear 120 is released, the energy stored within the spring 122 quickly rotates the rod 24 thereby swinging the bat 25. This mechanism is designed to provide a consistent swing of the bat 25 with only an instantaneous delay. The swinging operation of the bat 25 is desirably consistent in order to instill confidence in the player of his actual control over the operation of the game.

A means may also be provided to adjust position of the bat 25. For example, the position of the rod 24 may be moved to the right or left (as viewed in FIG. 2 from the perspective of the player) by a drive mechanism attached to a motor 170. The actuation frame 104 is slidably mounted on a pair of parallel horizontally positioned bars 176 and 178. Upon actuating a controller, the motor 170 rotates a gear 172 which engages a chain 174. The chain 174 is stationary and operates as a track along which the gear 172 may run. Therefore as the gear 172 rotates, the entire bat actuation unit 100 slides along the guide rods 176 and 178 adjusting the position of the rod 24 and the bat 25 to the right or left. Many other types of adjustments are envisioned. For example, the bat 25 could be adjustably rotated slightly to provide the player with control over the starting position of his swing. Though the described preferred embodiments set the bat 25 at a given height, means could be provided to raise or lower the height of the bat 25.

Though the circulation of the prizes is somewhat random, additional mechanisms could be provided to further mix the prizes. By releasing a prize and allowing it to freefall, its movement becomes entirely predictable. The machine completely relinquishes control of or contact with the prize and the force of gravity, a constant and non-alterable force, takes over.

This prize circulating and freefalling motion is also a visually appealing feature of the machine. The motion draws a potential player to the machine and challenges the player to try his skill.

Though a preferred embodiment has been described, many other actuation, adjustment and prize moving methods and mechanisms may be envisioned with the scope of the inventions and could be designed by one skilled in the art from the descriptions herein. One such alternative embodiment for the prize transferring mechanism is the double roller machine 210 in FIG. 7. The double roller scheme has a plurality of horizontal rollers 240 at a bottom portion of the machine 210 which transfer toys such as prize 205*a* to a second position within the vertically aligned back side rollers 250 pinching the toys between the back side rollers 250 and a corresponding front side rollers 255. Through rotation of the respective rollers 250 and 255, prizes are moved upward therebetween such as prize 205*b* until reaching the top position between rollers 260 and 265. Prizes are then moved forward between rollers 260 and 265 until a prize reaches the position (such as prize 205*c*) before dropping. Alternately a chute 269 may be provided to further direct the following prizes.

Though the embodiment described above illustrated a preferred bat actuation machine, many other mechanisms are envisioned for playing this game of striking or grabbing a falling object. Instead of a bat, a punching machine or other striking device could be provided. FIG. 7 also shows an alternative embodiment in which a projectile 226 is shot out of a shooting mechanism 225 being aimed to strike the freefalling prize 205*d* through the gates 280*a* and 280*b*. The projectile 226 226 could be provided. Yet another alternate could be ejecting a burst of air at the prize in order to drive the falling prize 205*d* toward the gate opening between gates 28*a* and 28*b*.

Figure 8:
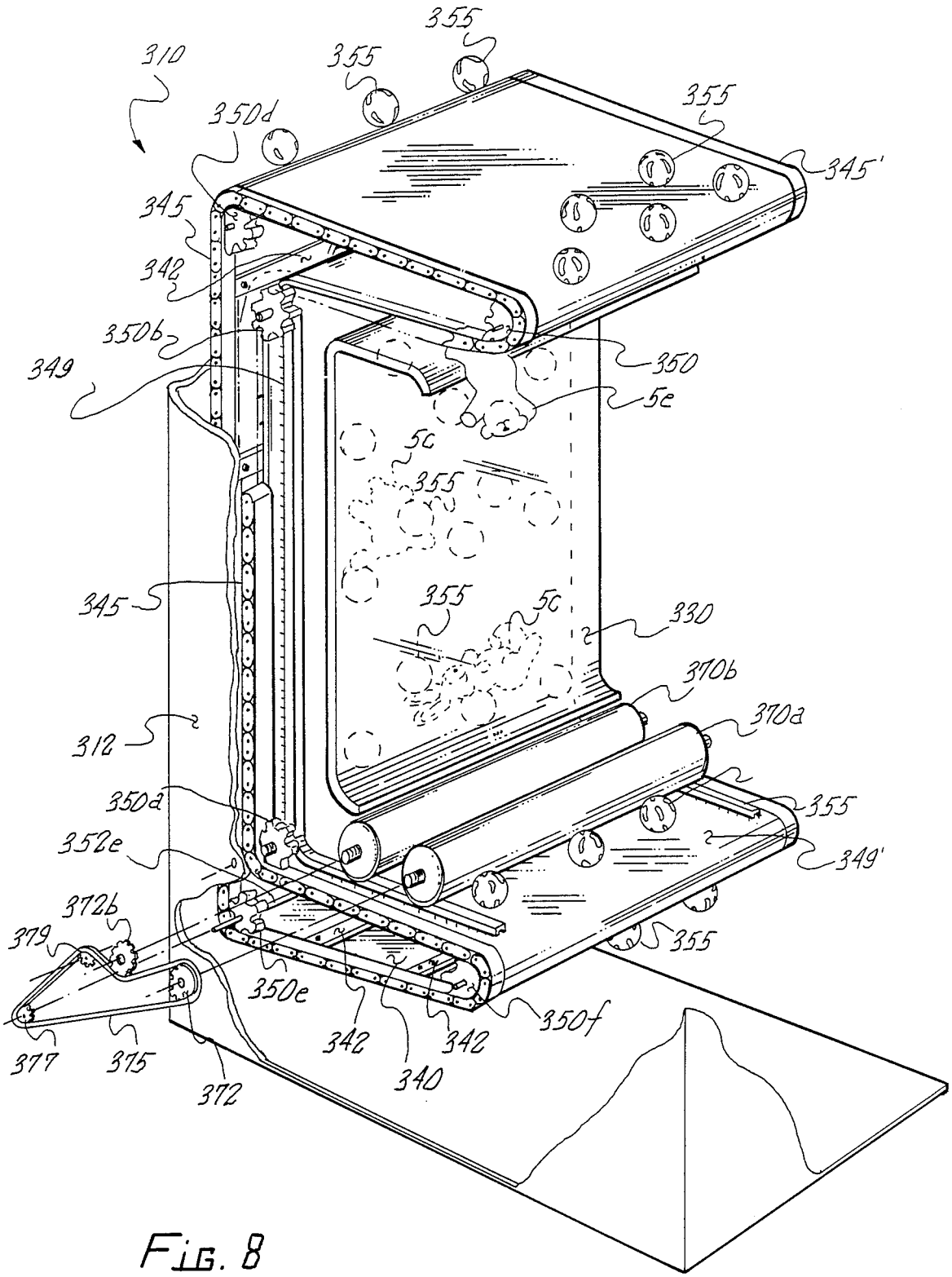
FIG. 8 is a diagrammatic perspective view of a preferred machine embodiment having alternative conveying means.
Figure 9:
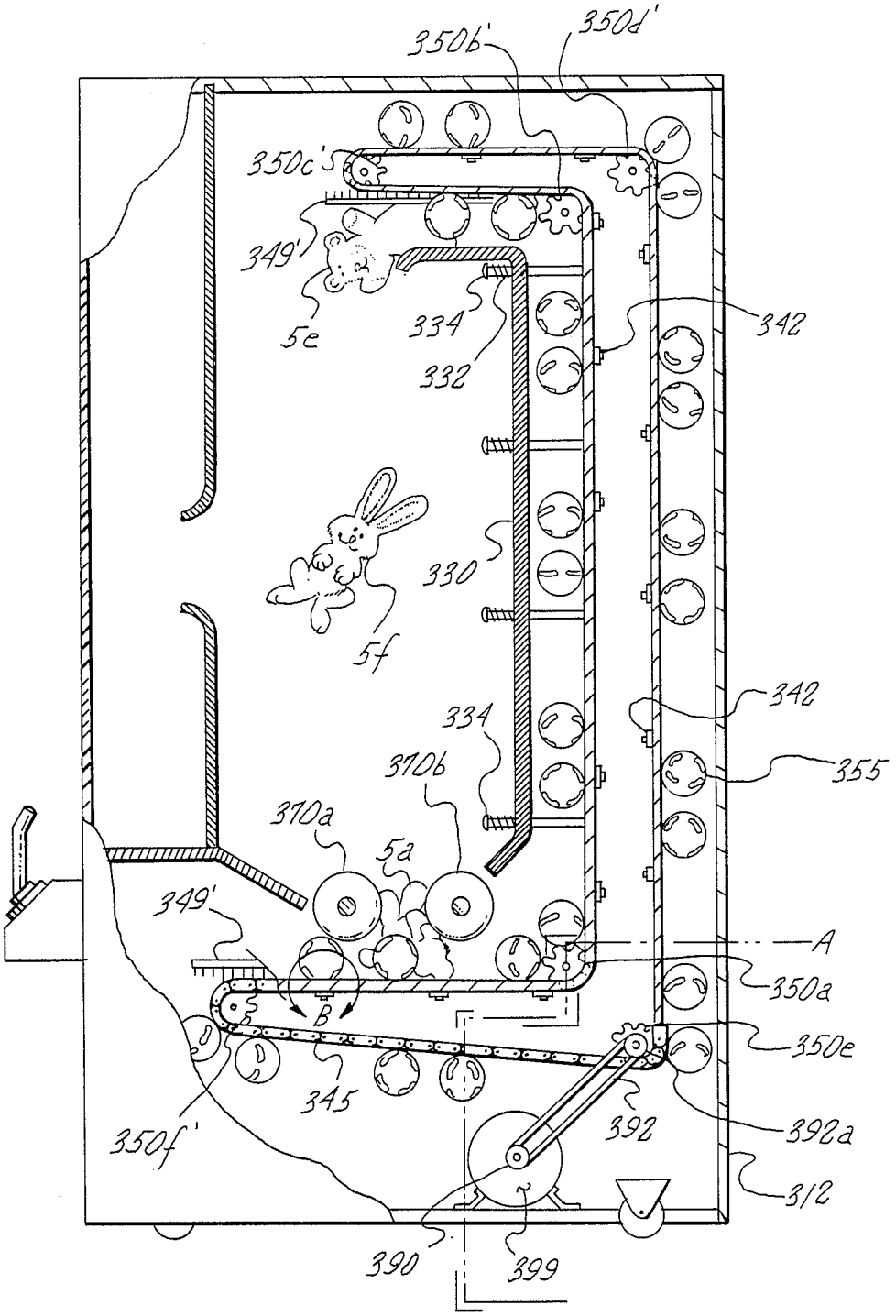
FIG. 9 is a right side elevation view of the machine of FIG. 8.

A preferred prize transferring mechanism is the conveyor system illustrated in FIGS. 8 and 9. FIG. 8 is a perspective view of freefall machine 310 using a conveyor belt 340 to transfer prizes 5 from a lower collecting area to an upper dropping position. The conveyor belt 340 is a continuous loop of flexible mesh canvas mounted on support brackets 342. The support brackets 342 extend the width of the belt 340 and are connected on either end to drive chains 345 and 345'. The chain 345 is also in a continuous loop supported and driven by gears 350*a–f*.

A plurality of balls 355 (shown as plastic whiffle balls having diameters of 2 and 7/8ths inches) are attached to the canvas belt 340 at various locations. The balls 355 act as carriers to the prizes 5, moving the prizes from the lower portion to the upper portion. The balls are oriented in groups of five. Each group of five balls has its balls arranged in two horizontal rows with a row of two over a row of three.

Referring also to FIG. 9, a prize 5*f* falling to the bottom portion are slowly fed between rollers 370*a* and 370*b* onto the belt 340. The prize is grasped by the balls 355 and then moved under a clear shield 330 where the prize 5*c* is trapped between the belt 340 and the shield 330 thereby moving up with the moving conveyor belt 340. Once reaching the top portion, the prize 5*e* is slid along the top of the shield 330 until dropping over the edge and allowed to fall. Though no prize striking mechanism is illustrated with this embodiment, any of the described prize striking mechanisms may be employed.

The shield 330 is supported by support studs 334, the studs having springs 332 which permit the shield to translate away from the belt 340 so as not to squeeze a prize too hard. Allowing the shield 330 to float as such helps avoid damaging the prizes. In order to protect the prizes from touching the chain a barrier is provided by a longitudinally placed brush 349.

The rollers 370*a* and 370*b* are supported in place and driven by gears 372*a* and 372*b*. A chain 375 connects the gears 372*a* and 372*b* to another gear 377 which is mounted on drive shaft 352*e*. An idler gear 379 maintains proper tension of the chain 375. The rollers 372 and 372(*b*) rotate in opposite directions to slowly feed prizes there between.

Figure 9A:
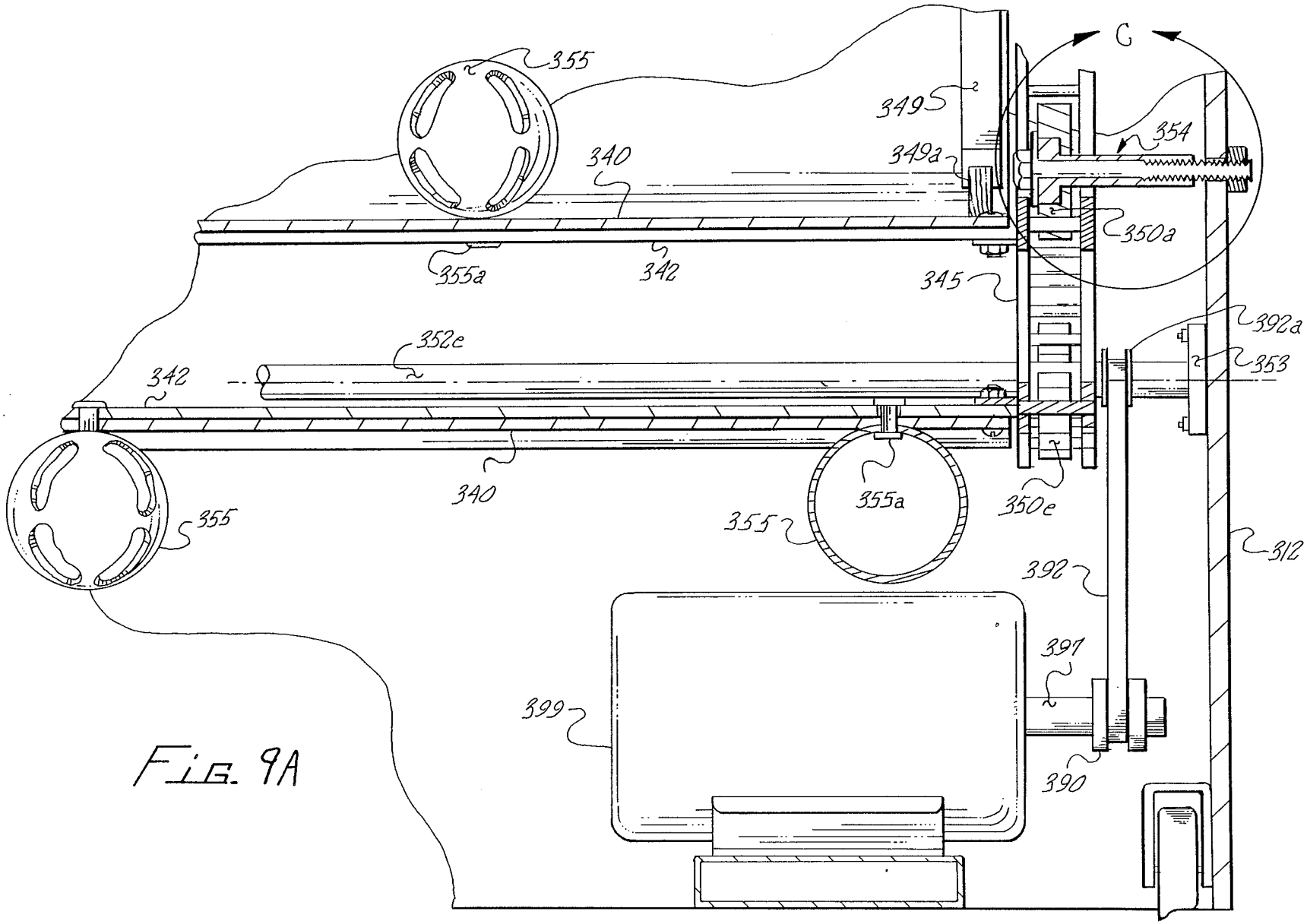
FIG. 9A is a cross sectional view of the machine of FIG. 9 taken along the line A—A of FIG. 9.

Referring also to FIG. 9A, the conveyor chain 345 is driven through the drive shaft 352*e* operably connected to the motor 399. The motor 399 rotates the motor wheel 390 which in turn engages belt or chain 392. The chain 392 transfers the rotation to the drive shaft 352*e*. The drive shaft 352*e* is mounted on bearings 353 mounted to a side wall 312.

Where the belt 340 carrying the prizes has to change directions, idler gears are provided such as gear 350*a'* in FIG. 9A, the gear being secured by a mounting means 354. As shown in detail in FIG. 9C, the gear 350*a'* is mounted on a bushing 354*c* and secured to the side wall 312 by bolt 354*a*, washer 354*b* and nut 354*d*.

Figure 9B:
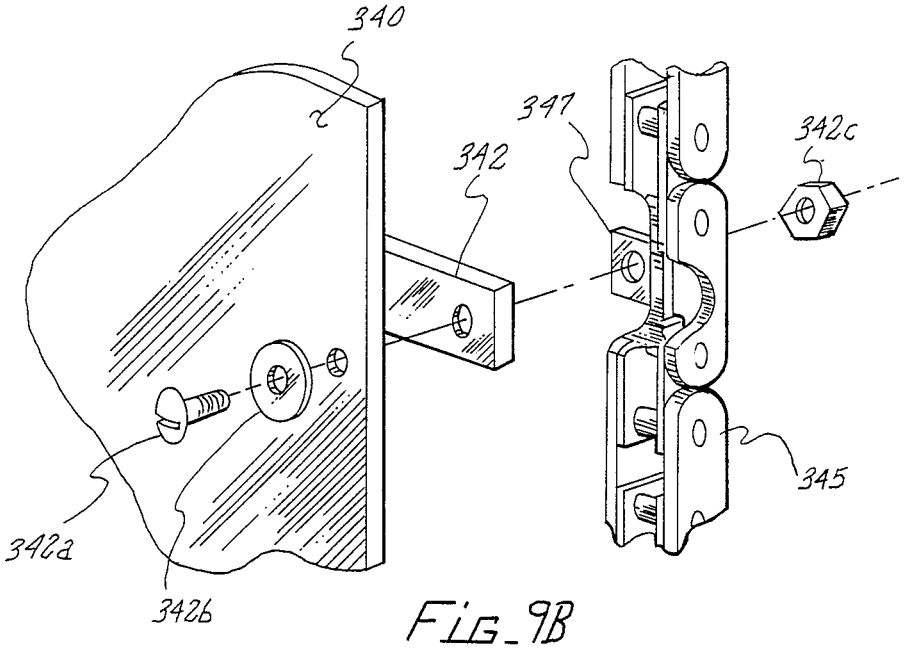
FIG. 9B is a detailed view from FIG. 9 of the attachment of the conveyor belt to the chain.
Figure 9C:
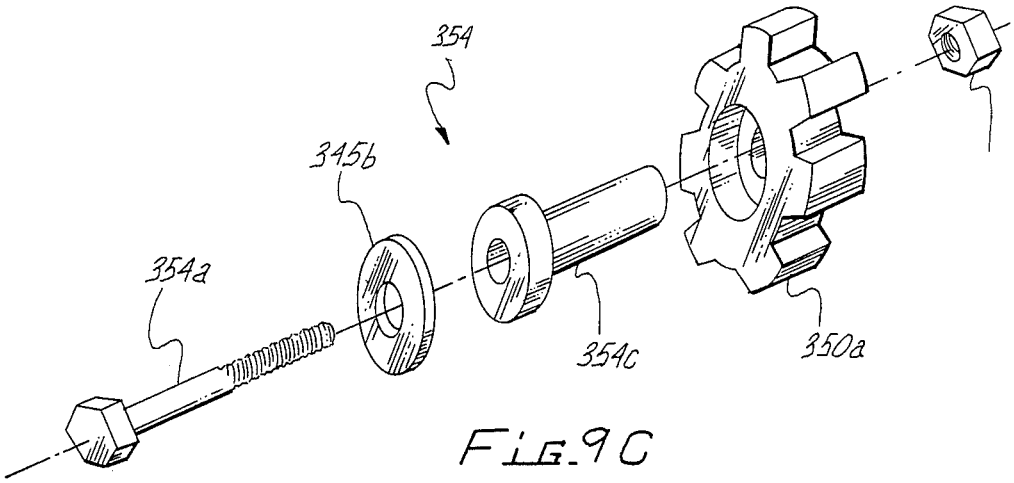
FIG. 9C is detailed exploded view from FIG. 9A of the side sprocket.

FIGS. 9A and 9B also illustrate the attachment means for the belt 340 to the chain 345. A bolt is placed through a washer 342*b*, the belt 340, the support bracket 342, and the tab 347 (which is attached to the chain 345) and then secured by nut 342*c*.

The balls 355 are attached to the belt 340 at the support brackets 342 by rivets 355*a* or other or other suitable attachment means.

Other prize transferring and circulating means could include other conveyor systems, a ferris wheel type system, a crane claw system transferring a prize from a lower portion of the machine to an upper portion and fully releasing the prize and allowing it to freefall so that during the freefall the player may attempt to strike, shoot, grab or otherwise affect the freefalling object and if successful get a prize. Of course, a prize or object need not be dispensed as the game may simply entail, for example, keeping score of how many objects are successfully struck.

Thus a new prize dispensing apparatus and arcade game method has been shown and described. Though certain advantages and alternatives have been described, many more applications and modifications will become apparent to those skilled in the art from the descriptions herein. The invention therefore is to be limited only in the spirit of the claims that follow.

What is claimed is:

1. A method for dispensing prizes in an arcade-type machine comprising the steps of:

placing a plurality of prizes in the machine;

circulating the prizes from a first position in a lower portion of the machine up to a second position at an upper portion of the machine;

dropping the prizes from the second position at the upper portion of the machine and allowing the prizes to free fall to the lower portion of the machine;

providing a mechanism for striking a prize as it free falls from the second position at the upper portion to the first position at the lower portion of the machine; and dispensing a successfully struck prize.

2. The method of claim 1 wherein prizes are struck by actuating a bat mechanism.

3. The method of claim 1 wherein prizes are struck by activating a shooting mechanism.

4. The method of claim 1 wherein prizes are struck by activating a punching mechanism.

5. The method of claim 1 further comprising opening a gate to a predetermined size and requiring a successfully struck prize pass through the gate in order to be dispensed.

6. The method of claim 5 further comprising allowing the player to select the size of the gate opening.

7. A method for dispensing prizes in an arcade-type machine comprising the steps of:

placing at least one prize in the machine;

moving the prize from a first position in a lower portion of the machine up to a second position at an upper portion of the machine;

dropping the prize from the second position at the upper portion of the machine and allowing the prize to free fall to the lower portion of the machine;

attempting to strike or grab the prize as it free falls from the second position at the upper portion to the first position at the lower portion of the machine; and dispensing the prize if it is successfully struck or grabbed.

8. The method of claim 7 further comprising adjusting the spacing of a gate through which a successfully struck prize must pass.

9. An arcade-type game prize dispensing machine comprising:

a prize collection area;

a prize dropping area;

means for transferring prizes from the prize collection area upward to the prize dropping area;

means for dropping prizes from the prize dropping area toward the prize collection area;

means for striking a prize as it falls from the prize dropping area to the prize collection area;

a prize dispensing area; and means for moving a successfully struck prize to the prize dispensing area.

10. The arcade-type prize dispensing machine of claim 9 further comprising: a gate having a predetermined opening, the gate being positioned adjacent the striking means such that a successfully struck prize must pass through the gate in order to be moved to the prize dispensing area.

11. The arcade-type prize dispensing machine of claim 10 further comprising: means for selecting the size of the opening of the gate.

12. The arcade-type prize dispensing machine of claim 10 wherein the means for striking comprises a mechanism controlled by the player selected from the group consisting of: a bat, a puncher, a projectile shooter, and a means for ejecting a burst of air.

13. The arcade-type prize dispensing machine of claim 9 wherein the means for transferring prizes comprises a plurality of horizontally oriented rollers stacked in a vertical plane and positioned parallel one another, each roller being capable of pinching a prize between its outer surface against a second surface and as a roller rotates it moves the prize to a subsequent higher roller.

14. The arcade-type prize dispensing machine of claim 12 wherein the rollers have a soft foam surface for gently grasping prizes.

15. The arcade-type prize dispensing machine of claim 13 wherein the second surface is a transparent material through which a player may view the prizes as they are transferred up to the dropping area.

16. The arcade-type prize dispensing machine of claim 13 wherein the second surface is comprised of a plurality of vertically oriented parallel bars having spaces in between, the spaces being small enough to generally prevent prizes from passing therethrough.

17. The arcade-type prize dispensing machine of claim 13 wherein the second surface is comprised of a plurality of parallel, horizontally oriented rollers.

18. The arcade-type prize dispensing machine of claim 9 wherein the prize collecting-area comprises a plurality of horizontally oriented rollers positioned parallel one another in a horizontal plane on which the prizes are dropped, each roller being rotatable to move a prize to a subsequent roller toward the transferring means.

19. A game machine comprising:

an object dropping area;

a object landing area;

means for transferring objects from the object landing area upward to the object dropping area;

means for dropping objects from the object dropping area toward the object landing area;

means for striking an object as it falls from the object dropping area to the object landing area, and means for registering when an object is successfully struck.

20. The game machine of claim 19 wherein the means for registering comprises a second object landing area which accepts the successfully struck object and means for counting objects entering the second object landing area.

21. The game machine of claim 19 further comprising means for dispensing a successfully struck object.

22. A game machine comprising:

an object dropping area;

a object landing area;

means for transferring objects from the object landing area upward to the object dropping area;

means for dropping objects from the object dropping area toward the object landing area; and means for striking an object as it falls from the object dropping area to the object landing area, wherein the means for transferring objects comprises a plurality of horizontally oriented rollers stacked in a vertical plane and positioned parallel one another, each roller being capable of pinching an object between its outer surface against a second surface and as a roller rotates it moves the object to a subsequent higher roller.

* * * * *